US012588764B1

(12) United States Patent
Lougee

(10) Patent No.: US 12,588,764 B1
(45) Date of Patent: Mar. 31, 2026

(54) COLLAPSIBLE STADIUM CHAIR

(71) Applicant: Strongback LLC, Worcester, MA (US)

(72) Inventor: Laurence Lougee, San Francisco, CA (US)

( * ) Notice: Subject to any disclaimer, the term of this patent is extended or adjusted under 35 U.S.C. 154(b) by 0 days.

(21) Appl. No.: 17/877,290

(22) Filed: Jul. 29, 2022

(51) Int. Cl.

| | |
|---|---|
| ***A47C 1/16*** | (2006.01) |
| ***A47C 1/024*** | (2006.01) |
| ***A47C 1/026*** | (2006.01) |
| ***A47C 4/04*** | (2006.01) |
| ***A47C 4/28*** | (2006.01) |
| ***A47C 7/46*** | (2006.01) |
| *A47C 1/027* | (2006.01) |
| *A47C 4/32* | (2006.01) |
| *A47C 4/42* | (2006.01) |

(52) U.S. Cl.
CPC ..... *A47C 1/16* (2013.01); *A47C 1/024* (2013.01); *A47C 1/026* (2013.01); *A47C 4/04* (2013.01); *A47C 4/28* (2013.01); *A47C 7/46* (2013.01); *A47C 1/027* (2013.01); *A47C 4/32* (2013.01); *A47C 4/42* (2013.01)

(58) Field of Classification Search
CPC ..... A47C 1/16; A47C 1/024; A47C 1/026; A47C 4/04; A47C 4/28; A47C 1/027; A47C 4/32; A47C 4/42; A47C 7/626; A47C 7/622; A47C 7/62; A47C 7/40; A47C 7/42; A47C 7/425; A47C 7/407
See application file for complete search history.

(56) References Cited

U.S. PATENT DOCUMENTS

| | | | | | |
|---|---|---|---|---|---|
| 2,040,942 | A * | 5/1936 | Katenkamp | A47C 1/023 | 297/383 |
| 2,043,433 | A * | 6/1936 | Archibald | A47C 1/026 | 297/373 |
| 2,137,335 | A * | 11/1938 | Horsfield | A47C 1/026 | 297/375 |
| 2,254,684 | A * | 9/1941 | Franks | A47C 1/16 | 297/252 |
| 3,362,747 | A * | 1/1968 | Fuelling | A47C 1/027 | 297/373 |
| 3,994,529 | A * | 11/1976 | Lippert | A47C 1/16 | 297/134 |
| 4,165,900 | A * | 8/1979 | Pesiri | A47C 1/026 | 297/301.7 |
| 4,555,136 | A * | 11/1985 | Dranger | A47C 1/143 | 16/302 |

(Continued)

*Primary Examiner* — Robert Canfield
(74) *Attorney, Agent, or Firm* — Brian M. Dingman; Prince Lobel Tye LLP

(57) ABSTRACT

A collapsible stadium seat with a seat member that defines a base plane, and seat membrane support members. A seat membrane is coupled to and spans the space between the seat membrane support members to define a user seating surface. The seat membrane is angled backward such that its front portion is farther from the base plane than is its back portion. There is also a cantilevered back that is pivotably coupled to the seat member and includes first and second spaced back support members. A back membrane is coupled to the support members. The support members are angled or curved to define a lumbar support region. There are back adjustment mechanisms that can be locked and unlocked and allow the back to pivot, to establish a comfortable use position.

20 Claims, 12 Drawing Sheets

(56) References Cited

U.S. PATENT DOCUMENTS

| | | | | | |
|---|---|---|---|---|---|
| 4,709,962 | A * | 12/1987 | Steinmann | A47C 1/03272 | 297/316 |
| 5,100,201 | A * | 3/1992 | Becker, III | A47C 31/126 | 297/301.5 |
| 5,779,314 | A * | 7/1998 | Grace | A47C 4/44 | 297/380 |
| 5,913,572 | A * | 6/1999 | Grimaldi | A47C 1/143 | 297/39 |
| 6,502,902 | B1 * | 1/2003 | Romero | A47C 1/16 | 297/352 |
| 6,890,033 | B1 * | 5/2005 | Casella | A47C 4/42 | 297/344.21 |
| D891,135 | S * | 7/2020 | Chen | D6/362 | |
| 10,874,216 | B2 * | 12/2020 | Grace | A47C 1/16 | |
| 11,166,554 | B1 * | 11/2021 | Romero | A47C 7/56 | |
| 11,241,095 | B1 * | 2/2022 | Sun | A47C 4/06 | |
| D956,440 | S * | 7/2022 | Chen | D6/368 | |
| 2007/0018491 | A1 * | 1/2007 | Jones | A47C 1/16 | 297/352 |
| 2010/0244515 | A1 * | 9/2010 | Ivicevic | A47C 1/03272 | 297/239 |
| 2012/0062005 | A1 * | 3/2012 | Cvek | A47C 1/03 | 297/301.1 |
| 2014/0359930 | A1 * | 12/2014 | Chlapaty | A47C 4/286 | 4/496 |
| 2017/0290441 | A1 * | 10/2017 | Whitted | A47C 1/12 | |
| 2019/0231074 | A1 * | 8/2019 | Grace | A45F 3/14 | |
| 2019/0374034 | A1 * | 12/2019 | Zhu | A47C 4/20 | |
| 2020/0405055 | A1 * | 12/2020 | Sun | A47C 7/543 | |
| 2021/0298479 | A1 * | 9/2021 | Sun | A47C 4/30 | |
| 2021/0321776 | A1 * | 10/2021 | Plant | A47C 1/121 | |
| 2023/0129979 | A1 * | 4/2023 | Djankovich | A47C 7/444 | 297/32 |

* cited by examiner

COLLAPSIBLE STADIUM CHAIR

BACKGROUND

This disclosure relates to a stadium seat.

Stadium seats add comfort when sitting in stadiums and other locations with benches and bleachers. However, stadium seats can be very uncomfortable.

SUMMARY

Aspects and examples are directed to a collapsible stadium seat with good lumbar support, and in some examples a backwardly-sloped seat that helps to keep the user in a position in which their back is supported by the cantilevered back of the stadium seat.

All examples and features mentioned below can be combined in any technically possible way.

In one aspect, a collapsible stadium seat includes a seat member with a frame base that defines a base plane, first and second spaced seat membrane support members supported by the frame base, and a seat membrane with a front end and a back end. The seat membrane is coupled to and spans the space between the first and second seat membrane support members to define a user seating surface. In an example the seat membrane is angled backward such that its front portion is farther from the base plane than is its back portion. In another example the seat member includes a cushion with an upper surface, a front end and a back end. The cushion is configured to be removably coupled to the frame base such that the cushion upper surface is angled from the base plane at an acute angle, with the cushion front end farther from the base plane than the cushion back end.

There is a cantilevered back that is pivotably coupled to the seat member. The back includes first and second spaced back support members each including at least a first portion and a second portion. The first and second portions of each back support member meet at an obtuse angle. The second portion of each back support member is farther from the base plane than is the first portion of the respective back support member. In an example the first portion and the second portion of the back support members extend toward a front of the seat member. There is a back membrane that is coupled to and spans the space between the first and second back support members to define a user back-supporting surface. The back membrane is coupled to the first and second portions of the first and second back support members such that the back membrane is held in tension, creating a curved lumbar support region for a user.

There is a back support and adjustment mechanism that includes first and second pivoting mechanisms, one located at an intersection of the first back support member and the seat member and the other located at an intersection of the second back support member and the seat member. The first and second pivoting mechanisms are configured to establish at least a deployed or use configuration wherein a distal end of the back extends away from the seat member base plane and a collapsed configuration wherein the distal end of the back lies closer to the seat member base plane.

Some examples include one of the above and/or below features, or any combination thereof. In one disclosed example the seat member and the back are pivotably connected via the first and second pivoting mechanisms. One or both of the pivoting mechanisms is configured to be locked and unlocked. When locked the back is fixed relative to the seat member. When unlocked the back is configured to be pivoted relative to the seat member. In this example each pivot mechanism includes a pivot plate and a stationary plate, the pivot plate configured to be engaged with the stationary plate. In one illustrated example each pivot mechanism includes a plurality of protrusions on the pivot plate that are configured to engage with a plurality of protrusions on the stationary plate. The locked configuration is defined when the protrusions on the pivot plate are engaged with the protrusions on the stationary plate and the unlocked configuration is defined when the protrusions on the pivot plate are disengaged from the protrusions on the stationary plate.

Some examples include one of the above and/or below features, or any combination thereof. Each of the pivot mechanisms can include a handle that is configured to manipulate the pivot mechanism between the locked configuration and the unlocked configuration. In the illustrated example each of the two pivot mechanisms is connected to both the seat member and the back. In some examples the seat support members each have a front end that is farther from a pivoting mechanism than is a back end, and at least the rear portions of the seat support members are angled from the base plane at an acute angle. In the illustrated example the seat support members are each fixed to a separate one of the pivoting mechanisms and the back support members are each fixed to a separate one of the pivoting mechanisms.

In another example a brace bar is connected between the first and second back support members and spaced from the back membrane. In an example the brace bar defines the most distal portion of the back. In another example the brace bar is located behind the back support members and offset from and spaced behind the back membrane. In an example the seat support members each have a front end that is farther from a pivoting mechanism than is a back end, and the seat support members are angled from the base plane at an acute angle.

BRIEF DESCRIPTION OF THE DRAWINGS

Various aspects of at least one example are discussed below with reference to the accompanying figures, which are not intended to be drawn to scale. The figures are included to provide illustration and a further understanding of the various aspects and examples, and are incorporated in and constitute a part of this specification, but are not intended as a definition of the limits of the inventions. In the figures, identical or nearly identical components illustrated in various figures may be represented by a like reference character or numeral. For purposes of clarity, not every component may be labeled in every figure. In the figures.

DETAILED DESCRIPTION

Figure 1:
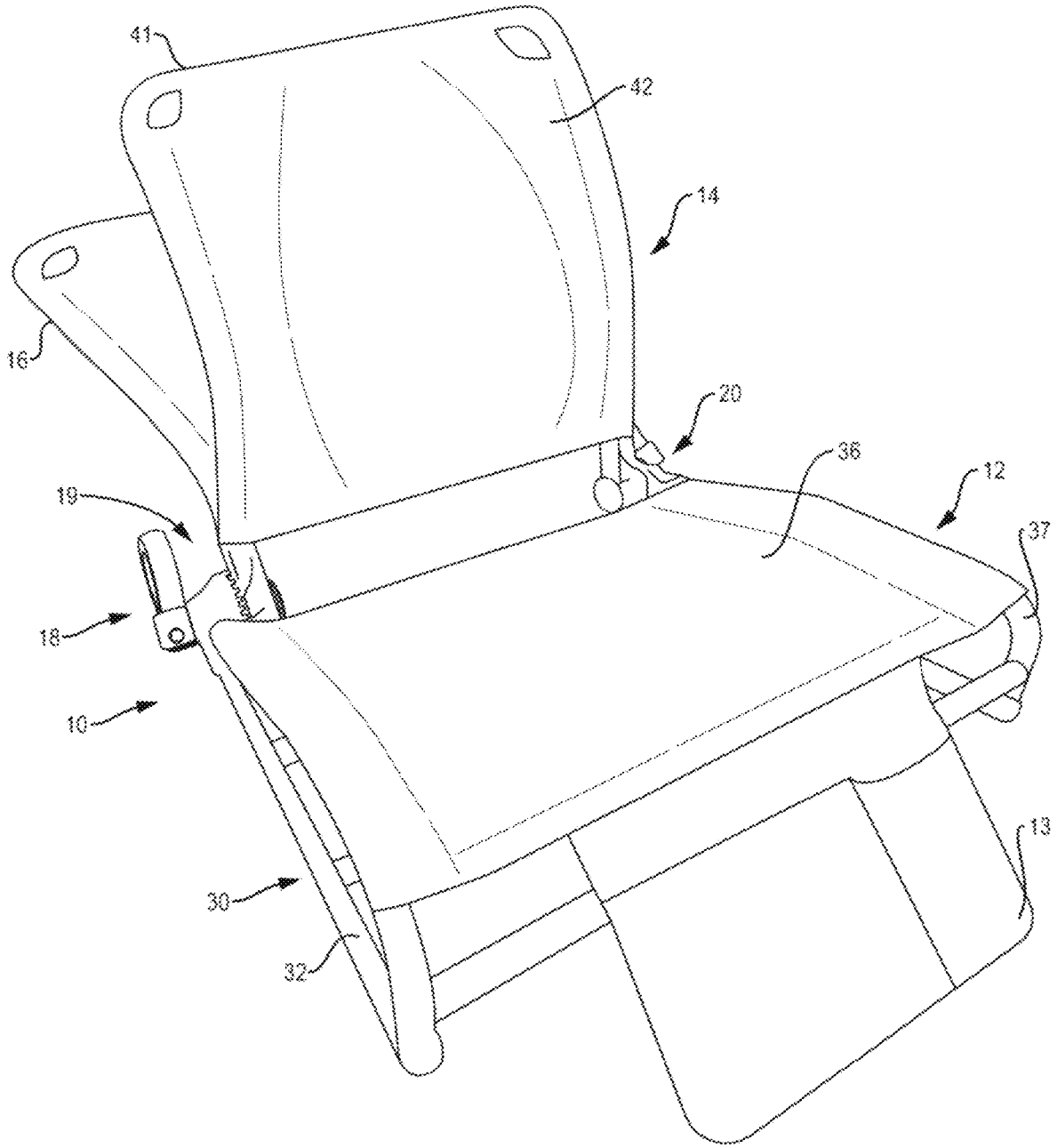
FIG. 1 is a front perspective view of a collapsible stadium seat, with the back in two different configurations.
Figure 2:
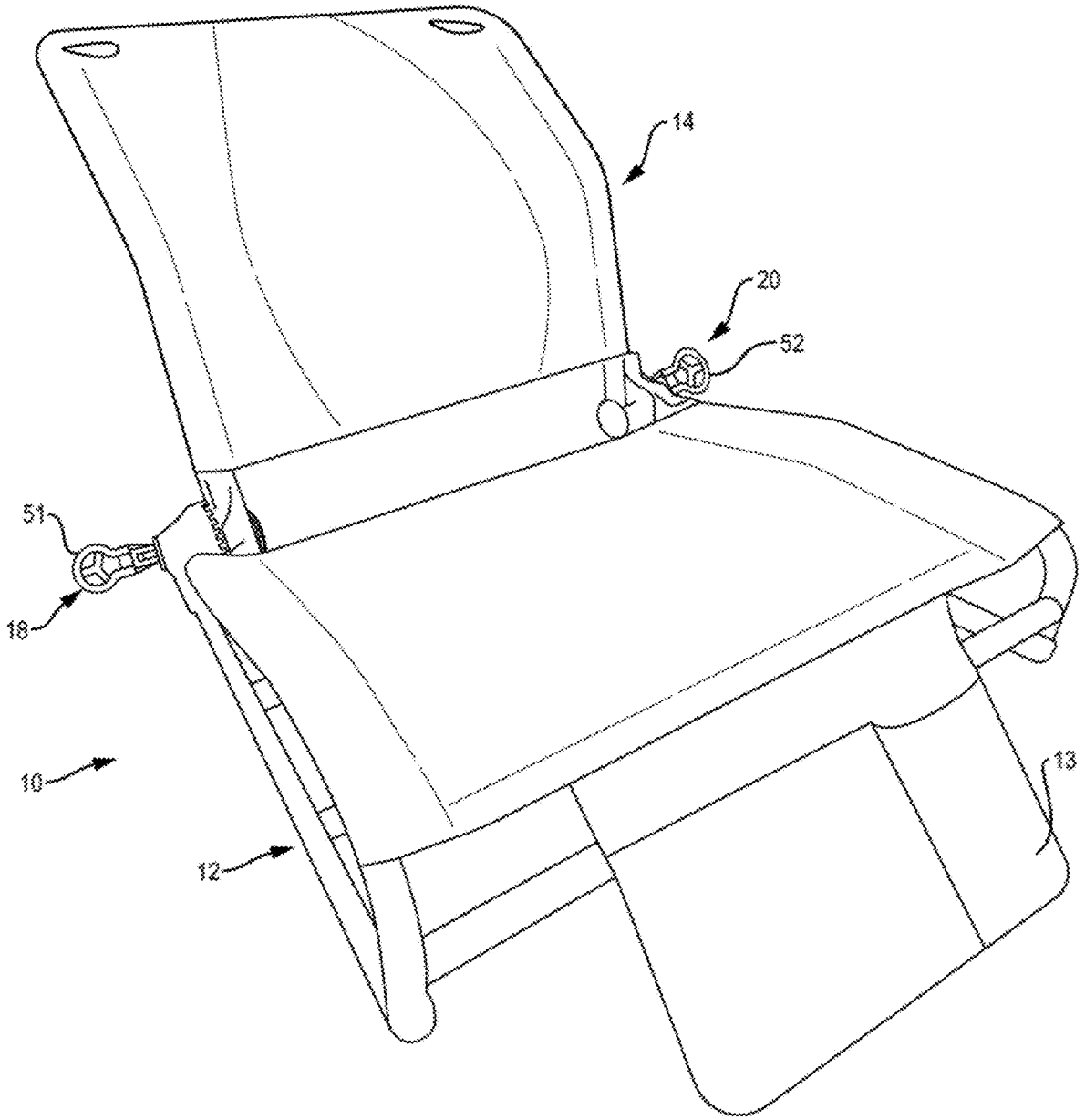
FIG. 2 is a similar view to FIG. 1 but with the locking back pivoting mechanisms in an unlocked state.

This disclosure features a collapsible stadium seat. In one example the collapsible stadium seat includes a seat member with a frame base that defines a base plane, first and second spaced seat membrane support members supported by the frame base, and a seat membrane with a front end and a back end. The seat membrane is coupled to and spans the space between he first and second seat membrane support members to define a user seating surface. In one example the seat membrane is angled backward such that its front portion is farther from the base plan than is its back portion. In another example the seat member includes a cushion with an upper surface, a front end and a back end. The cushion is configured to be removably coupled to the frame base such that the cushion upper surface is angled from the base plane at an acute angle, with the cushion front end farther from the base plane than is the cushion back end.

There is a cantilevered back that is pivotably coupled to the seat member. The back includes first and second spaced back support members each including a first portion and a second portion. The first and second portions of each back support member lie at obtuse angles to each other, to define a curve. The second portion of each back support member is farther from the base than is the first portion of the respective back support member. The two portions of the back support members extend toward a front of the seat member. There is a back membrane that is coupled to and spans the space between the first and second back support members to define a user back-supporting surface. The back membrane is coupled to the first and second portions of the first and second back support members such that the back membrane is held in tension over the curve of the back support members, creating a curved lumbar support region for a user. In some examples the back also includes a brace bar connected between the first and second back support members and spaced behind the back membrane.

There is a back support and adjustment mechanism that includes first and second pivoting mechanisms, one located at an intersection of the first back support member and the seat member and the other located at an intersection of the second back support member and the seat member. The first and second pivoting mechanisms are configured to establish at least a deployed or use configuration wherein a distal end of the back extends away from the seat member base plane and a collapsed configuration wherein the distal end of the back lies closer to the seat member base plane.

In one disclosed example the seat member and the back are pivotably connected via the first and second pivoting mechanisms. One or both of the pivoting mechanisms is configured to be locked and unlocked. When locked the back is fixed relative to the seat member. When unlocked the back is configured to be pivoted relative to the seat member. In this example each pivot mechanism includes a pivot plate and a stationary plate, the pivot plate configured to be engaged with the stationary plate. In one illustrated example each pivot mechanism includes a plurality of protrusions on the pivot plate that are configured to engage with a plurality of protrusions on the stationary plate. The locked configuration is defined when the protrusions on the pivot plate are engaged with the protrusions on the stationary plate and the unlocked configuration is defined when the protrusions on the pivot plate are disengaged from the protrusions on the stationary plate.

Each of the pivot mechanisms can include a handle that is configured to manipulate the pivot mechanism between the locked configuration and the unlocked configuration. In the illustrated example each of the two pivot mechanisms is connected to both the seat member and the back. In some examples the seat support members each have a front end that is farther from a pivoting mechanism than is a back end, and the seat support members are angled from the base plane at an acute angle. In the illustrated example the seat support members are each fixed to a separate one of the pivoting mechanisms and the back support members are each fixed to a separate one of the pivoting mechanisms.

Disclosed examples discussed herein are not limited in application to the details of construction and the arrangement of components set forth in the following description or illustrated in the accompanying drawings. The apparatuses are capable of implementation in other examples and of being practiced or of being carried out in various ways. Examples of specific implementations are provided herein for illustrative purposes only and are not intended to be limiting. In particular, functions, components, elements, and features discussed in connection with any one or more examples are not intended to be excluded from a similar role in any other examples.

Examples disclosed herein may be combined with other examples in any manner consistent with at least one of the principles disclosed herein, and references to "an example," "some examples," "an alternate example," "various examples," "one example" or the like are not necessarily mutually exclusive and are intended to indicate that a particular feature, structure, or characteristic described may be included in at least one example. The appearances of such terms herein are not necessarily all referring to the same example.

Also, the phraseology and terminology used herein is for the purpose of description and should not be regarded as limiting. Any references to examples, components, elements, acts, or functions of the seat herein referred to in the singular may also embrace embodiments including a plurality, and any references in plural to any example, component, element, act, or function herein may also embrace examples including only a singularity. Accordingly, references in the singular or plural form are not intended to limit the presently disclosed systems or methods, their components, acts, or elements. The use herein of "including," "comprising," "having," "containing," "involving," and variations thereof is meant to encompass the items listed thereafter and equivalents thereof as well as additional items. References to "or" may be construed as inclusive so that any terms described using "or" may indicate any of a single, more than one, and all of the described terms.

An illustrative collapsible stadium seat is illustrated in FIGS. 1-8, 10 and 11. Another example is illustrated in FIG. 9.

Collapsible stadium seat 10, FIGS. 1-8, includes seat member 12 with a frame 30 that includes a base 32 that defines a base plane (not shown). Base 32 is made from members 32*a* and 32*b* (see FIG. 8A). First and second spaced seat membrane support members 34*a* and 34*b* (FIG.

8A) are supported by the frame base 32. There is a seat membrane 36 with a front end 36*a* and a back end 36*b* (see FIG. 6). The seat membrane is coupled to and spans the space between the first and second seat membrane support members to define a user seating surface. In some examples the seat membrane is angled backward such that its front portion is farther from the base plane than is its back portion.

There is a cantilevered back 14 that is pivotably coupled to the seat member. The back includes frame 100 made from first and second spaced back support members 101 and 103. Each of them includes a first portion and a second portion (e.g., portions 102 and 104 of member 101). The first and second portions of each back support member meet at an obtuse angle $\Theta_1$. The second portion of each back support member is farther from the base than is the first portion of the respective back support member. The first portion and the second portion of the back support members extend toward a front of the seat member. There is a back membrane 42 that is coupled to and spans the space between the first and second back support members to define a curved user back-supporting surface. The back membrane is coupled to the first and second portions of the first and second back support members such that the back membrane is held in tension and is taut, creating a curved lumbar support region for a user.

Figure 5A:
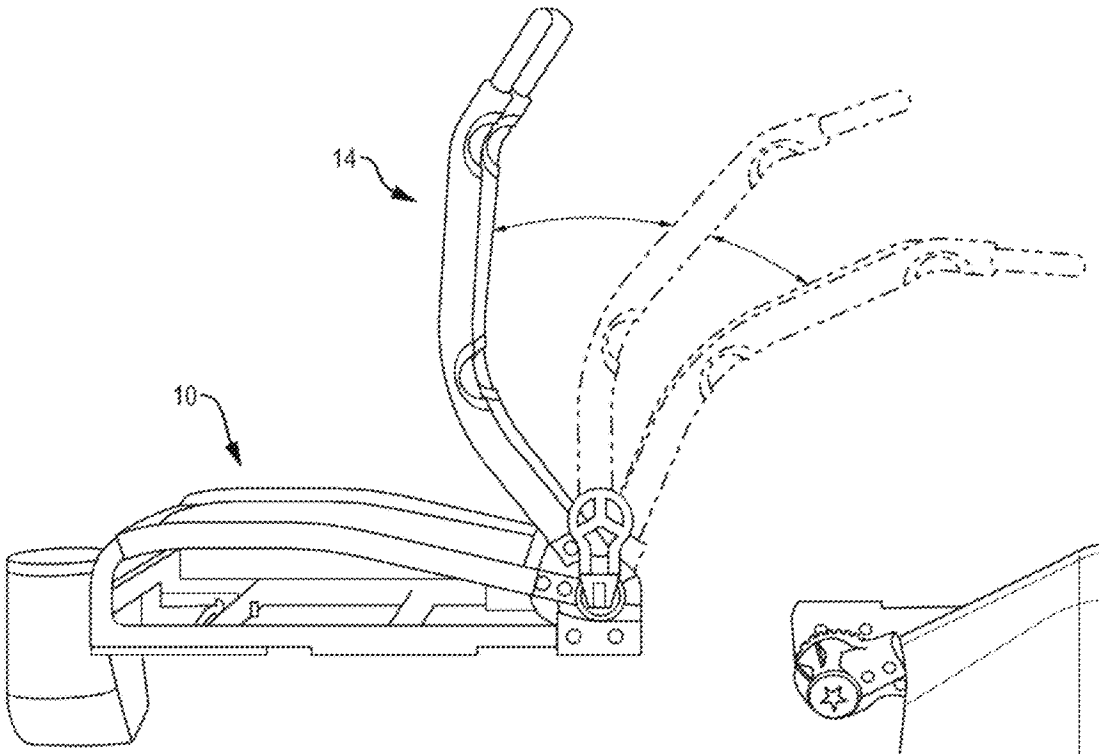
FIG. 5A illustrates several possible back locations.
Figure 5B:
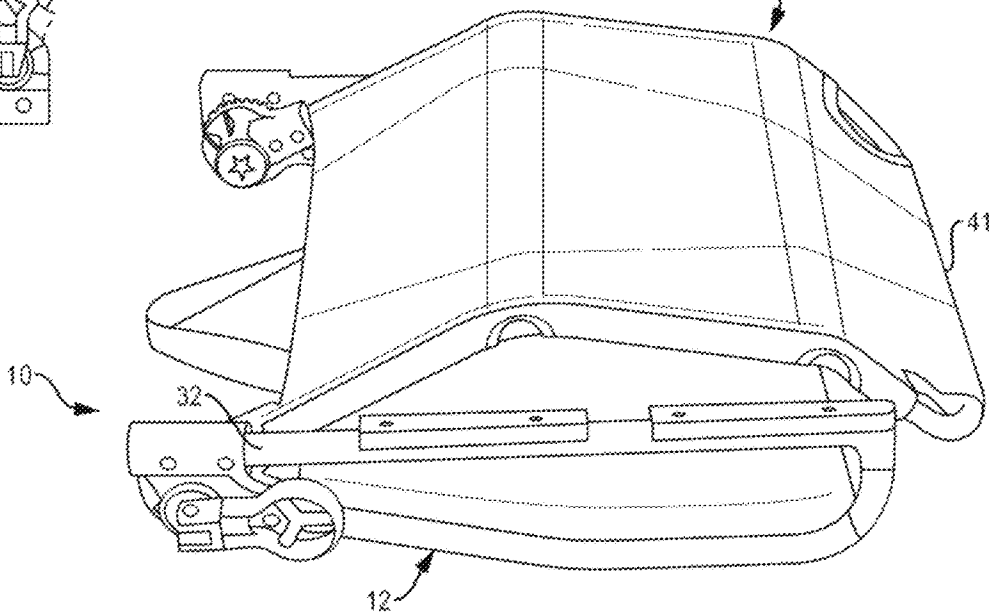
FIG. 5B illustrates a fully collapsed configuration.
Figure 6:
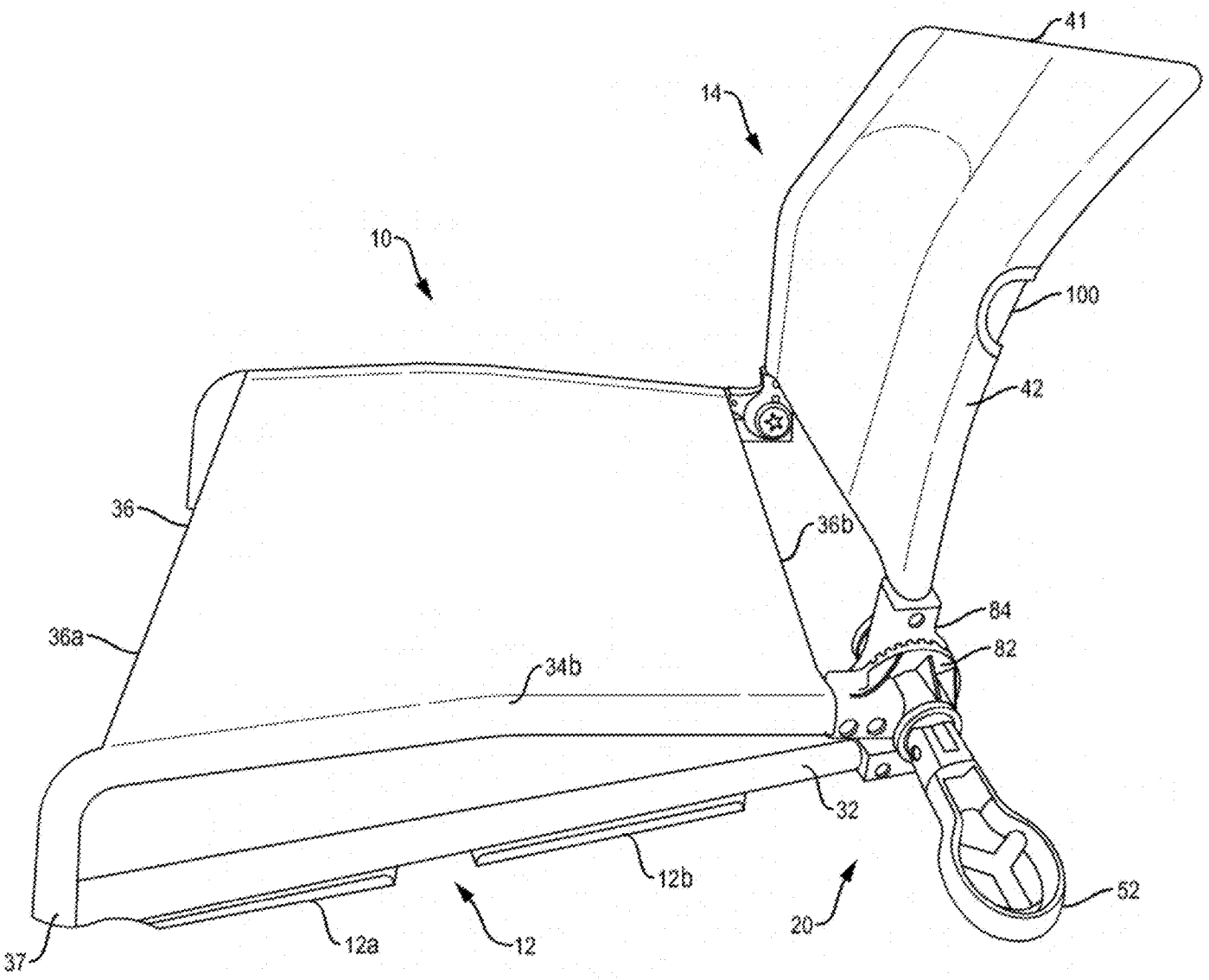
FIG. 6 illustrates a back pivoting mechanism.
Figure 7A:
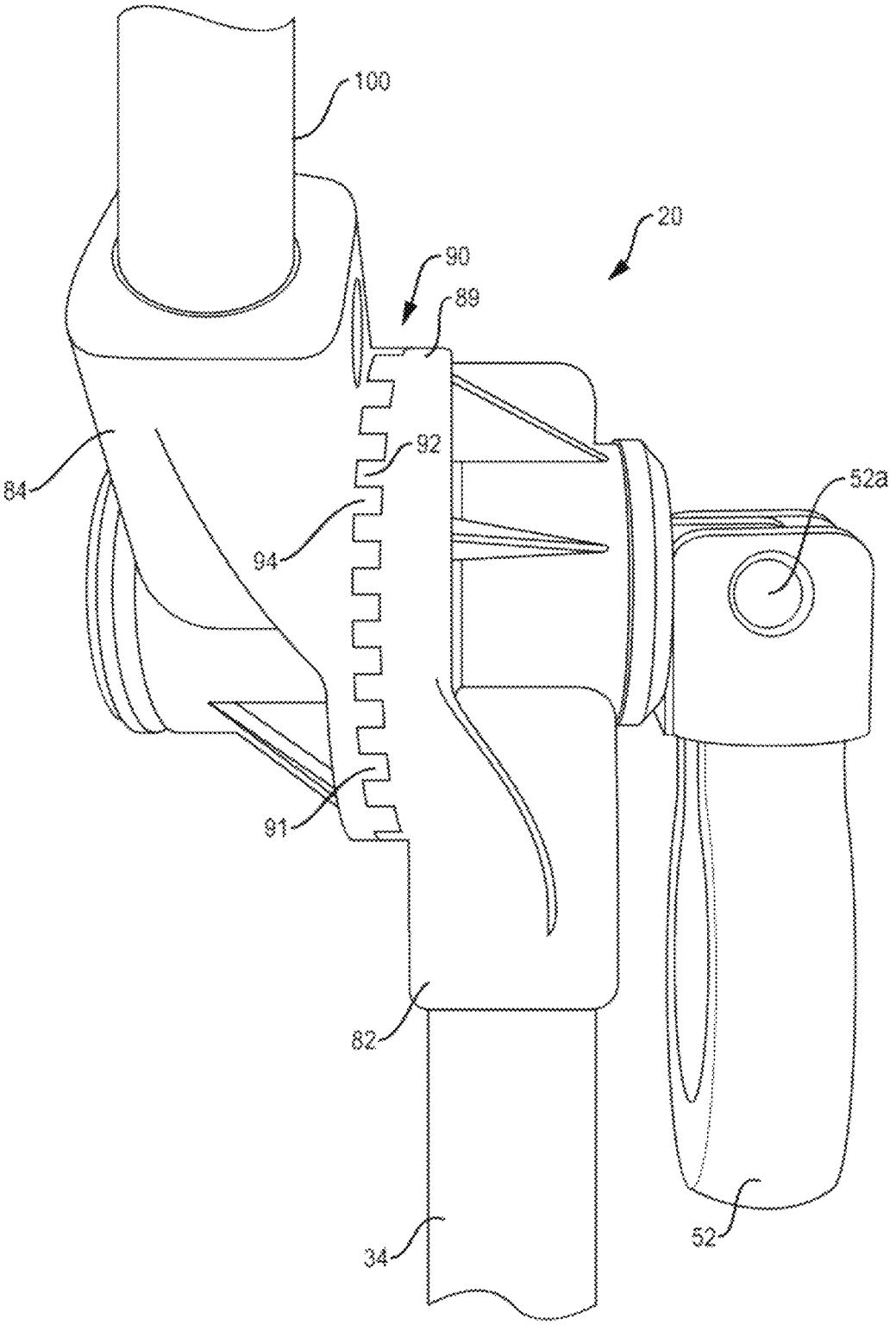
FIGS. 7A and 7B are close-up views of a back pivoting mechanism in the locked and unlocked positions, respectively.
Figure 7B:
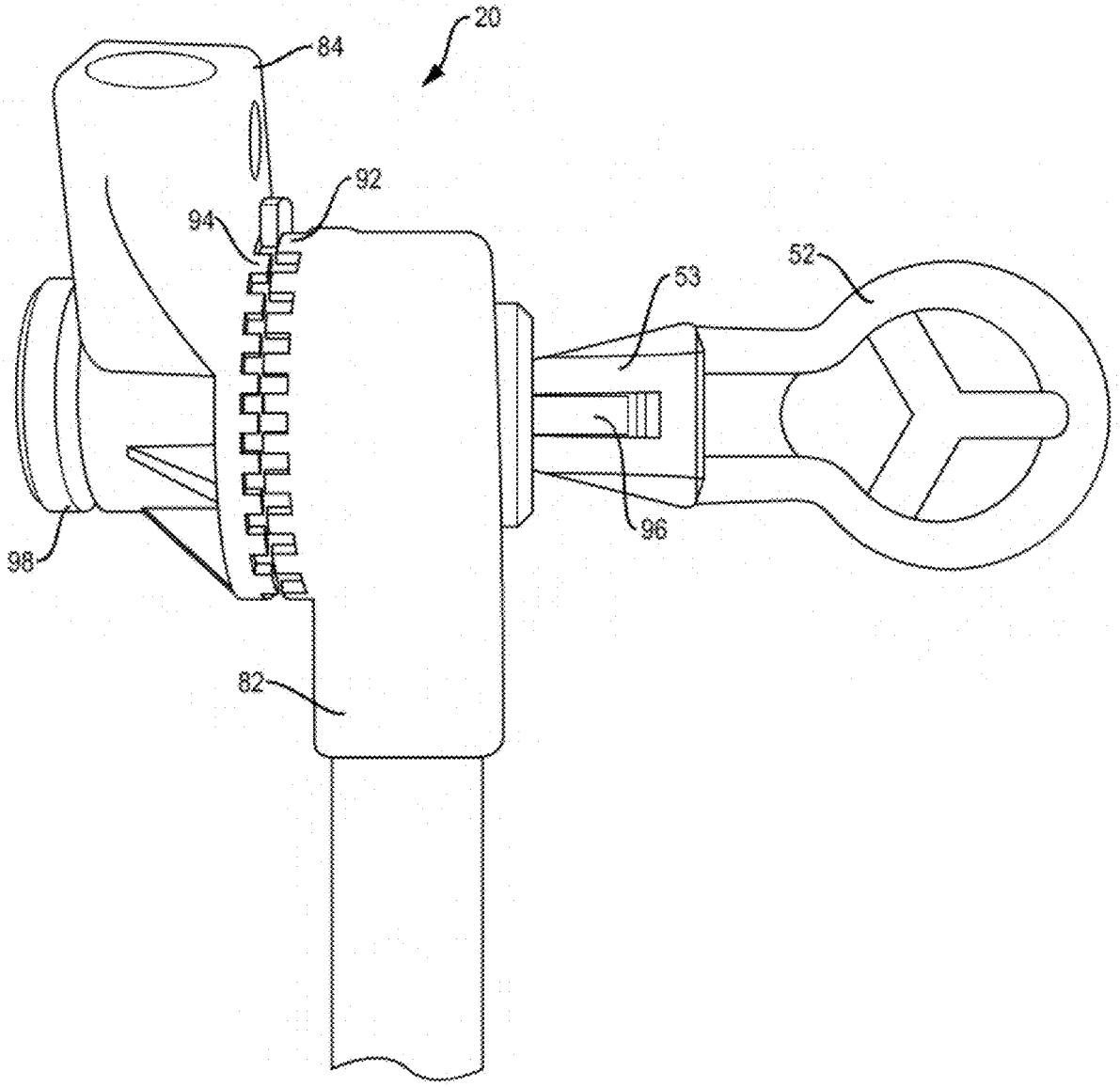
Figure 7C:
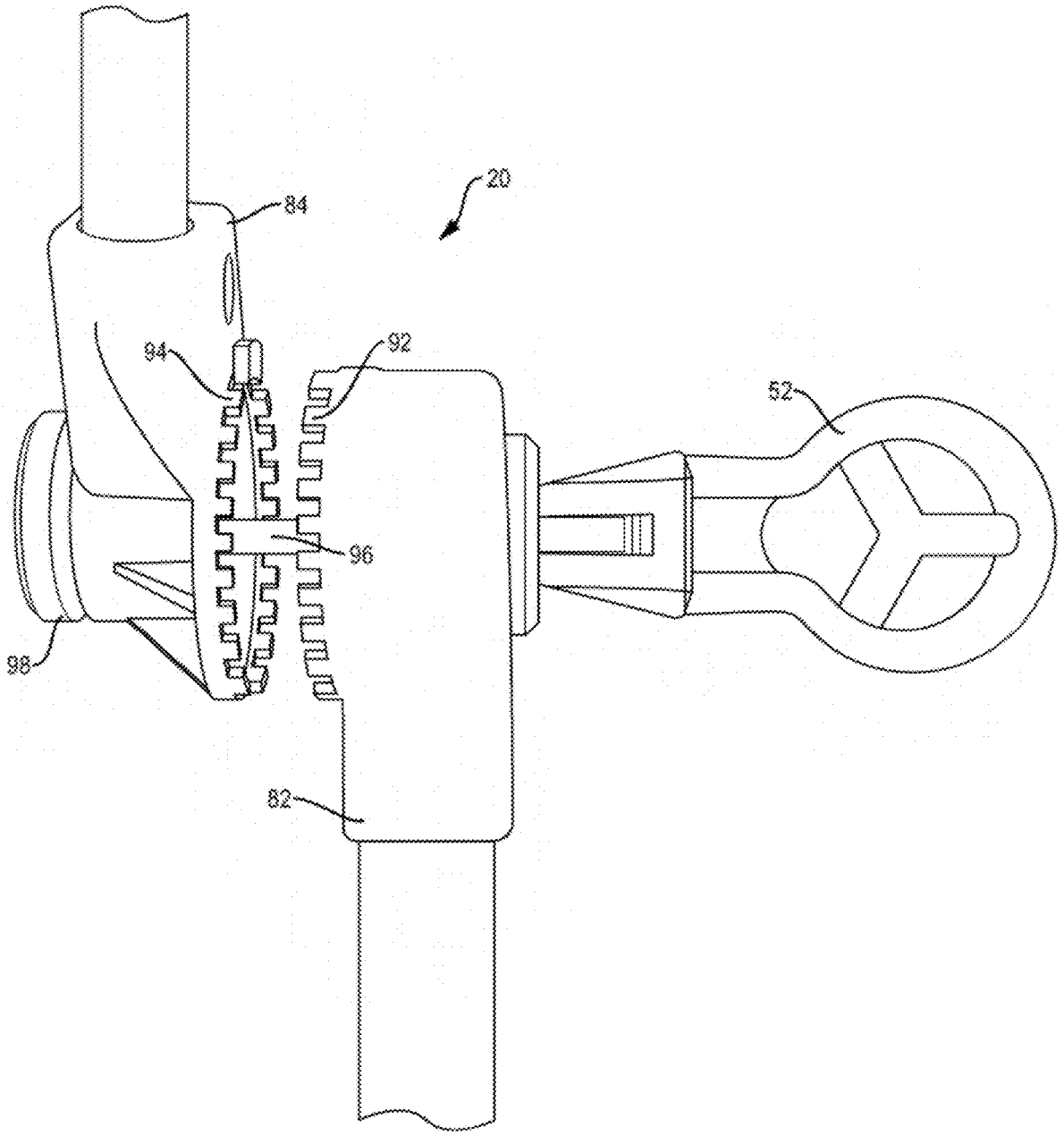
FIG. 7C is an exploded view of a back pivoting mechanism.

There is a back support and adjustment mechanism 19 that includes first and second pivoting mechanisms 18 and 20, one located at an intersection of the first back support member and the seat member and the other located at an intersection of the second back support member and the seat member. The first and second pivoting mechanisms are configured to establish at least a deployed configuration wherein a distal end of the back extends away from the seat member base plane and a collapsed configuration wherein the distal end of the back lies closer to the seat member base plane. FIGS. 1 and 5A show several of many possible deployed back positions 14 and 16, while the fully collapsed position (shown in FIG. 5B) has the back folded down and under the seat members, with back distal end 41 close to seat front end 37.

In one disclosed example the seat member and the back are pivotably connected via the first and second pivoting mechanisms. One or both of the pivoting mechanisms is configured to be locked and unlocked. When locked, the back is fixed relative to the seat member. When unlocked, the back is configured to be pivoted relative to the seat member.

Figure 3B:
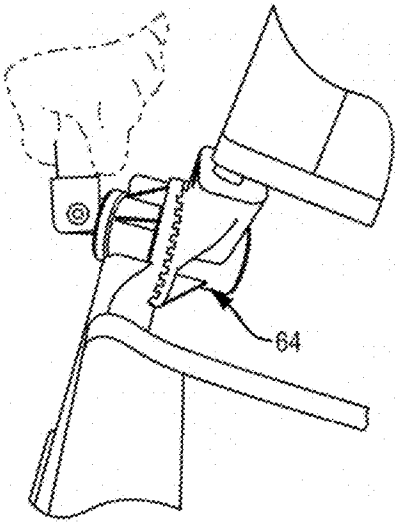
FIGS. 3A and 3B are more detailed views of a pivoting mechanism in an unlocked and locked state, respectively.
Figure 3A:
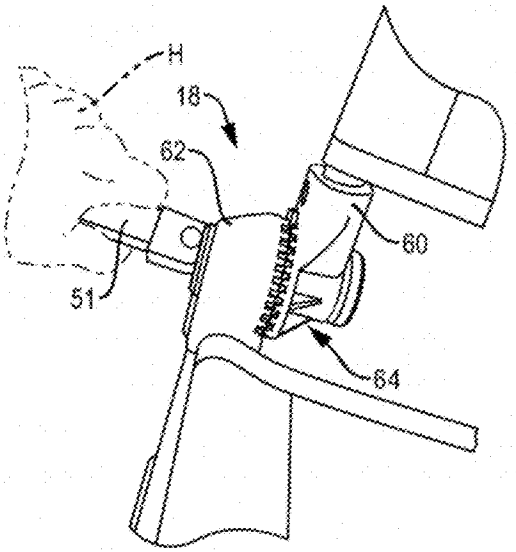

One example of a pivoting mechanism is shown in FIGS. 3A and 3B. Handle 51 is pivoted via user's hand H between the unlocked position shown in FIG. 3A and the locked position shown in FIG. 3B. Molded plastic mechanism portion 62 is coupled to the seat and mating molded plastic mechanism portion 60 is coupled to the back. Portions 62 and 60 engage and disengage at interfitting area 64.

In an example each pivot mechanism includes a pivot plate and a stationary plate, the pivot plate configured to be engaged with the stationary plate. For example, stationary plate 91 and rotatable pivot plate 89 of pivoting mechanism 20, FIGS. 7A-7C. In one illustrated example each pivot mechanism includes a plurality of protrusions 92 on the pivot plate that are configured to engage with a plurality of protrusions 94 on the stationary plate to create releasable locking mechanism 90. The locked configuration is defined when the protrusions on the pivot plate are engaged with the protrusions on the stationary plate (see FIG. 7A) and the unlocked configuration is defined when the protrusions on the pivot plate are disengaged from the protrusions on the stationary plate (see FIG. 7B). In this example the locking/unlocking is accomplished with user-operable handle 52 that pivots about pivot axis 52*a* that is coupled to connecting axle 96 that is fixed to head 98. When handle 52 is moved to the aligned position shown in FIGS. 3A and 7B its engaging surface 53 is moved away from the exposed side of molded plastic piece 82, 62, that is fixed to a seat member. When the handle is pivoted ninety degrees to the locking position shown in FIGS. 3B and 7A, handle surface 53 pushes piece 82 into molded plastic piece 84 that is fixed to a back member. The teeth engage to hold the selected back angle position. There can be one or two such pivoting mechanisms, preferably one on each side as illustrated to provide anchoring at both sides of the back and thus more stability.

Each of the pivot mechanisms can include a handle that is configured to manipulate the pivot mechanism between the locked configuration and the unlocked configuration. In the illustrated example each of the two pivot mechanisms is connected to both the seat member and the back. In some examples the seat support members each have a front end that is farther from a pivoting mechanism than is a back end, and the seat support members are angled from the base plane at an acute angle. In the illustrated example the seat support members are each fixed to a separate one of the pivoting mechanisms and the back support members are each fixed to a separate one of the pivoting mechanisms.

In a more specific example there are one or more base pads (e.g., 12*a* and 12*b*) on the base that are configured to be placed on a surface, to improve traction between the base and the surface. These pads can be made of plastic that provides more grip than would the metal base tubes 32*a* and 32*b*.

Figure 8A:
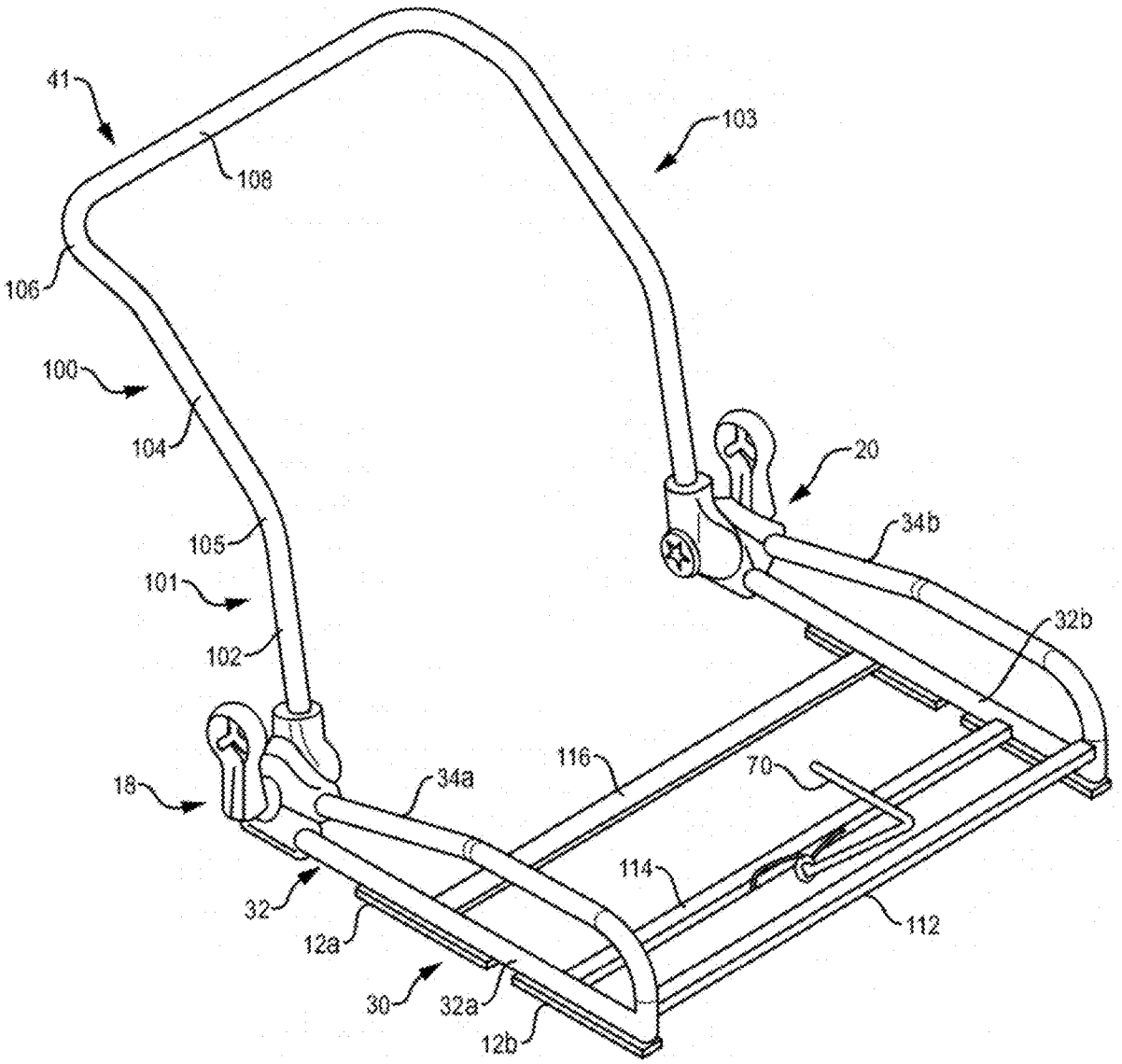
FIGS. 8A and 8B are front perspective and side views, respectively, of the frame of a collapsible stadium seat.
Figure 8B:
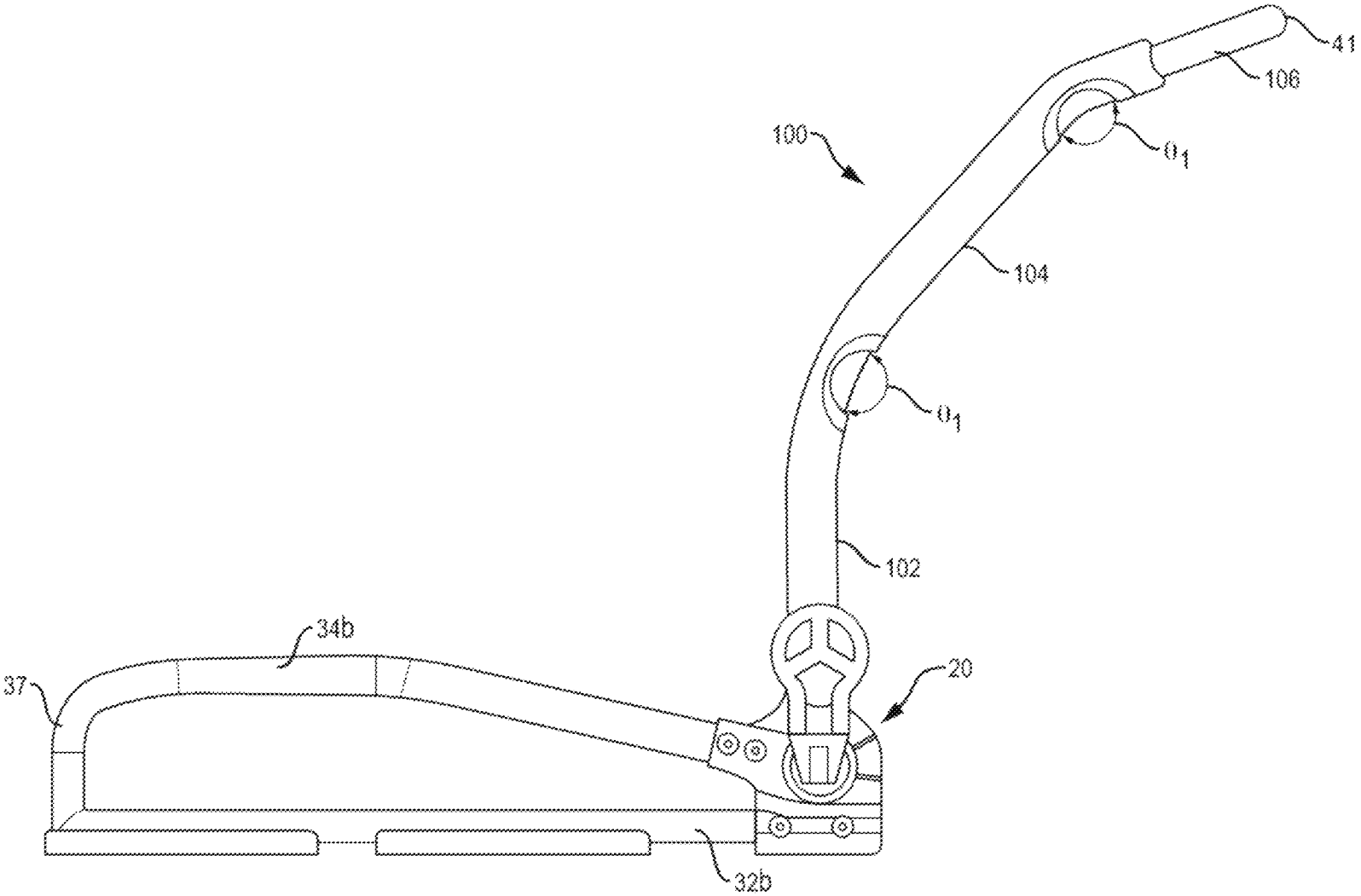

In an example the chair is made from tubular and/or flat steel or metal elements shown in FIGS. 8A and 8B, and a fabric seat cover 36 and a fabric back cover 42. The fabrics are strong and not stretchy. In an example the fabrics are rip-stop nylon. The metal elements of the seat member include seat support members 32*a*, 34*a*, 32*b*, and 34*b*, and stabilizing connecting members or brace bars 112, 114, and 116. Members 32*a* and 32*b* are the lower members and members 34*a* and 34*b* are the upper members to which the fabric is coupled. Front portions 37 connect the two at the front of the seat. The slight upward angle of the parts of the upper members closest to the back accomplishes a slightly backward-titled seat that forces the user's hips against the back membrane, placing the lumbar region against the lumbar curve in the back membrane. See FIG. 10. This curve is accomplished with back support members 101 and 103 of back 100, with a first section 102 that is coupled to a second section 104 that is angled with respect to section 102 at an obtuse angle $\Theta_1$. Sections 102 and 104 may meet at a bend 105. Third section 106 lies at obtuse angle $\Theta_2$ to section 104 and extends away from the back membrane, to place end cross or brace-bar 108 behind the user's back and head where it is less likely to touch the user; this makes the back and the chair more comfortable to sit in. Brace-bar 108 strengthens and stabilizes the back support members, to keep the back membrane taut. Note that back support members 101 and 102, and brace bar 108, may each be made of one or more pieces of tubular metal or other material that has the necessary strength and rigidity. The pieces can be bent or formed as necessary to create the overall shape.

Figure 4:
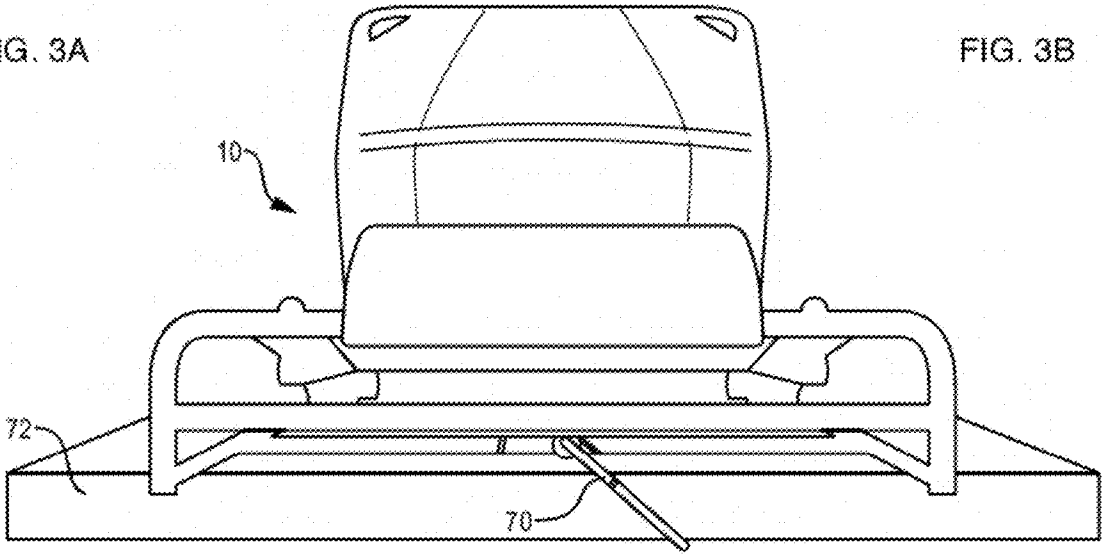
FIG. 4 is a front view of the collapsible stadium seat coupled to a bench.

Movable hook 70 is coupled to the seat member (e.g., to brace bar 114) such that it can pivot about a horizontal axis so that it can hook under a stadium bench or bleacher seat 72 (FIG. 4). Fabric pouch 13 can be located in front of the seat and can include one or more pockets that can hold items such as drink containers and other personal gear.

Figure 10:
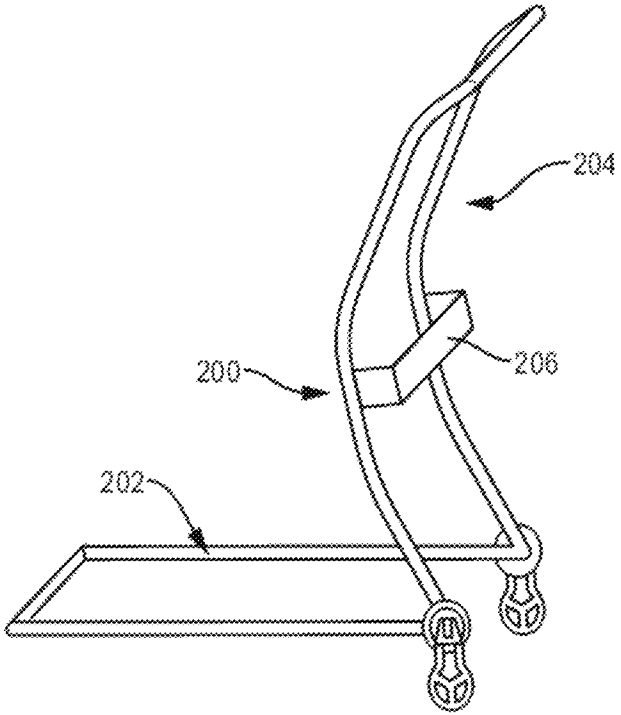
FIG. 10 is a schematic view of a different location of a back brace bar.

FIG. 10 illustrates seat frame 200 with seat 202. There is an alternative back brace bar 206 that is connected between the back support members of back 204, but at an intermediate location rather than at the distal end of the back. Bar 206 is offset backwards away from the back membrane so that the user's back does not touch the brace bar. Other configurations of a back brace bar that stabilizes the spaced back support members while not interfering with the user's back are within the scope of the disclosure.

Figure 11:
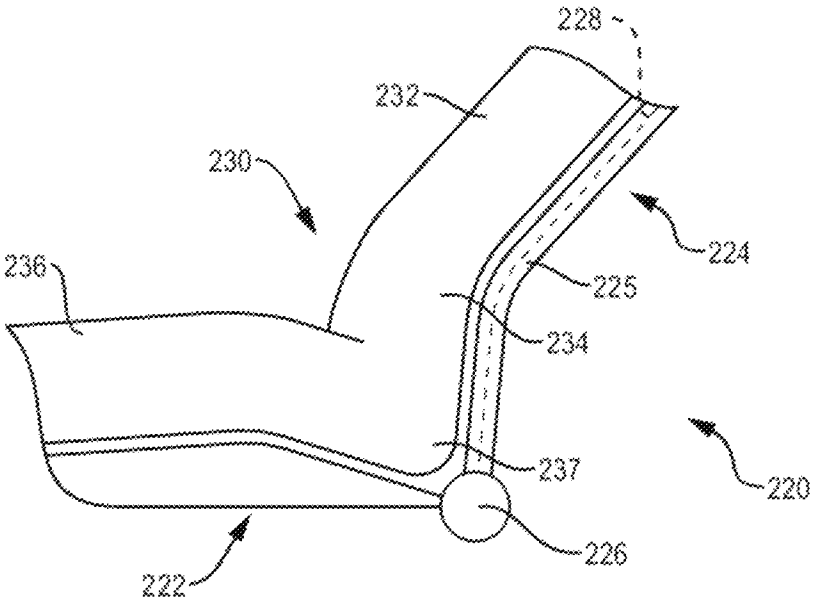
FIG. 11 is a partial schematic view illustrating how the user's lumbar region fits comfortably into the curved lumbar support region of the back

FIG. 11 illustrates how the chair supports the user, particularly the lumbar region of the back. Chair 220 includes seat 222 that is angled backward to where it intersects back 224 at pivot 226. Seat back 224 includes membrane 228. User 230 includes torso 232 and legs 236. Back 224 defines a curved lumbar support region 225 that is located about where a typical user's lumbar region 234 is located. The backward seat angle helps the hips 237 to sit close to the intersection of the seat and back of the chair, which places lumbar region 234 at or close to seat back curve 225.

Figure 9A:
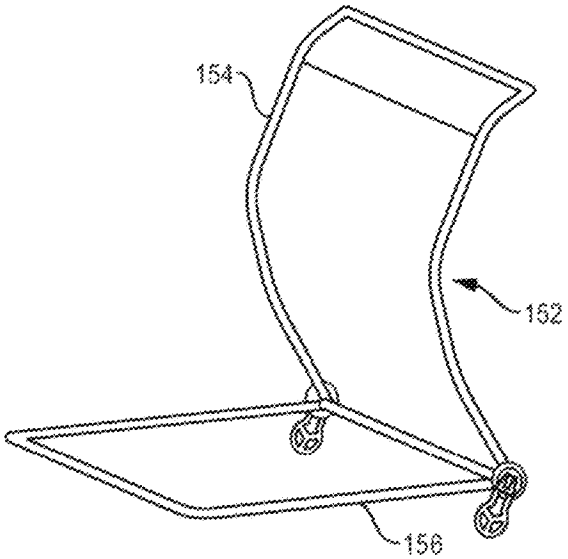
FIGS. 9A-9C illustrate the frame, the seat cushion, and an assembled view, respectively, of another example of a collapsible stadium seat.
Figure 9C:
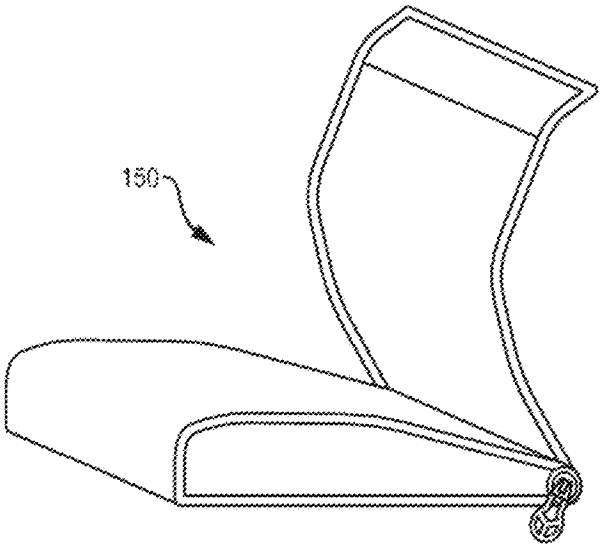
Figure 9B:
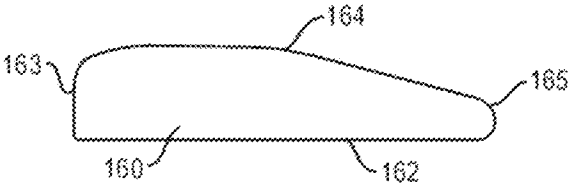

In another example shown in FIGS. 9A-9C the seat 150 includes a seat member cushion 160 with an upper surface 164, a front end 163 and a back end 165. The cushion is configured to be removably coupled to the frame base 156 of seat 152 (e.g., with snaps, clips, straps or hook and loop fasteners of other mechanical coupling structures) such that the cushion lower surface 162 is supported by the frame and its upper surface 164 is angled downward from front to rear where the seat back is. The angle is an acute angle from the base plane. The cushion front end is farther from the base than is the cushion back end. Cantilevered seat back 154 can have the same construction and operation as back 14.

Having described above several aspects of at least one example, it is to be appreciated various alterations, modifications, and improvements will readily occur to those skilled in the art. Such alterations, modifications, and improvements are intended to be part of this disclosure and are intended to be within the scope of the invention. Accordingly, the foregoing description and drawings are by way of example only, and the scope of the invention should be determined from proper construction of the appended claims, and their equivalents.

What is claimed is:

1. A collapsible stadium seat, comprising;

i) a seat member, comprising:

a frame base that defines a base plane;

first and second spaced seat membrane support members supported by the frame base; and a seat membrane with a front end and a back end, wherein the seat membrane is coupled to and spans the space between the first and second seat membrane support members to define a user seating surface;

ii) a cantilevered back that is pivotably coupled to the seat member, comprising:

first and second spaced back support members each including a first portion and a second portion, wherein the first and second portions of each back support member lie at an obtuse angle to each other, and wherein the second portion of each back support member is farther from the base plane than is the first portion of the respective back support member;

a back membrane that is coupled to and spans the space between the first and second back support members to define a user back-supporting surface, wherein the back membrane is coupled to both the first and second portions of each of the first and second back support members such that the back membrane is held in tension, creating a curved lumbar support region for a user; and a brace bar connected between the first and second back support members and spaced from the back membrane; and iii) a back support and adjustment mechanism, comprising:

first and second pivoting mechanisms, one located at an intersection of the first back support member and the seat member and the other located at an intersection of the second back support member and the seat member, wherein the first and second pivoting mechanisms are configured to establish at least a deployed configuration wherein a distal end of the back extends away from the seat member base plane and a collapsed configuration wherein the distal end of the back lies closer to the seat member base plane.

2. The collapsible stadium seat of claim 1, wherein the seat member and the back are pivotably connected via the first and second pivoting mechanisms, and wherein at least one of the first and second pivoting mechanisms is configured to be locked and unlocked, and when locked the back is fixed relative to the seat member and when unlocked the back is configured to be pivoted relative to the seat member.

3. The collapsible stadium seat of claim 2, wherein each pivot mechanism comprises a pivot plate and a stationary plate, the pivot plate configured to be engaged with the stationary plate.

4. The collapsible stadium seat of claim 3, wherein each pivot mechanism comprises a plurality of protrusions on the pivot plate that are configured to engage with a plurality of protrusions on the stationary plate, the locked configuration defined when the protrusions on the pivot plate are engaged with the protrusions on the stationary plate and the unlocked configuration defined when the protrusions on the pivot plate are disengaged from the protrusions on the stationary plate.

5. The collapsible stadium seat of claim 4, wherein each pivot mechanism further comprises a handle that is configured to manipulate the pivot mechanism between the locked configuration and the unlocked configuration.

6. The collapsible stadium seat of claim 1, wherein the seat membrane is angled backward such that its front portion is farther above the base plane than is its back portion.

7. The collapsible stadium seat of claim 1, wherein the brace bar defines the most distal portion of the back.

8. The collapsible stadium seat of claim 1, wherein the seat support members each have a front end that is farther from a pivoting mechanism than is a back end, wherein the seat support members are angled from the base plane at an acute angle.

9. The collapsible stadium seat of claim 8, wherein the seat support members are each fixed to a separate one of the pivoting mechanisms and the back support members are each fixed to a separate one of the pivoting mechanisms.

10. A collapsible stadium seat, comprising;

i) a seat member, comprising:

a frame base that defines a base plane;

first and second spaced seat membrane support members supported by the frame base; and a seat membrane with a front end and a back end, wherein the seat membrane is coupled to and spans the space between the first and second seat membrane support members to define a user seating surface, wherein the seat membrane is angled backward such that its front portion is farther above the base plane than is its back portion;

ii) a cantilevered back that is pivotably coupled to the seat member, comprising:

first and second spaced back support members each including a first portion and a second portion, wherein the first and second portions of each back support member lie at an obtuse angle to each other, and wherein the second portion of each back support member is farther from the base plane than is the first portion of the respective back support member; and a back membrane that is coupled to and spans the space between the first and second back support members to define a user back-supporting surface, wherein the back membrane is coupled to both the first and second portions of each of the first and second back support members such that the back membrane is held in tension, creating a curved lumbar support region for a user; and iii) a back support and adjustment mechanism, comprising:

first and second pivoting mechanisms, one located at an intersection of the first back support member and the seat member and the other located at an intersection of the second back support member and the seat member, wherein the first and second pivoting mechanisms are configured to establish at least a deployed configuration wherein a distal end of the back extends away from the seat member base plane and a collapsed configuration wherein the distal end of the back lies closer to the seat member base plane.

11. The collapsible stadium seat of claim 10, wherein the seat member and the back are pivotably connected via the first and second pivoting mechanisms, and wherein at least one of the first and second pivoting mechanisms is configured to be locked and unlocked, and when locked the back is fixed relative to the seat member and when unlocked the back is configured to be pivoted relative to the seat member.

12. The collapsible stadium seat of claim 11, wherein each pivot mechanism comprises a pivot plate and a stationary plate, the pivot plate configured to be engaged with the stationary plate.

13. The collapsible stadium seat of claim 12, wherein each pivot mechanism comprises a plurality of protrusions on the pivot plate that are configured to engage with a plurality of protrusions on the stationary plate, the locked configuration defined when the protrusions on the pivot plate are engaged with the protrusions on the stationary plate and the unlocked configuration defined when the protrusions on the pivot plate are disengaged from the protrusions on the stationary plate.

14. The collapsible stadium seat of claim 13, wherein each pivot mechanism further comprises a handle that is configured to manipulate the pivot mechanism between the locked configuration and the unlocked configuration.

15. The collapsible stadium seat of claim 14, wherein each of two pivot mechanisms is connected to both the seat member and the back.

16. The collapsible stadium seat of claim 10, wherein the back further comprises a brace bar connected between the first and second back support members and spaced from the back membrane.

17. The collapsible stadium seat of claim 10, wherein the seat support members each have a front end that is farther from a pivoting mechanism than is a back end, wherein the seat support members are angled from the base plane at an acute angle.

18. The collapsible stadium seat of claim 17, wherein the seat support members are each fixed to a separate one of the pivoting mechanisms.

19. The collapsible stadium seat of claim 18, wherein the back support members are each fixed to a separate one of the pivoting mechanisms.

20. A collapsible stadium seat, comprising;

i) a seat member, comprising:

a frame base that defines a base plane; and a cushion with an upper surface, a front end and a back end, wherein the cushion is configured to be removably coupled to the frame base such that the cushion upper surface is angled from the base plane at an acute angle, with the cushion front end farther from the base than the cushion back end;

ii) a cantilevered back that is pivotably coupled to the seat member, comprising:

first and second spaced back support members each including a first angled portion and a second angled portion, wherein the first and second angled portions of each back support member lie at different angles to the base plane and the second angled portion of each back support member is farther from the base than is the first angled portion of the respective back support member, wherein the upper angled portion and the lower angled portion of the back support members extend toward a front of the seat member; and a back membrane that is coupled to and spans the space between the first and second back support members to define a user back-supporting surface, wherein the back membrane is coupled to the upper angled portions and the lower angled portions of the first and second back support members such that the back membrane is held in tension and is taut, creating a lumbar support region for a user; and iii) a back support and adjustment mechanism, comprising:

first and second pivoting mechanisms, one located at an intersection of the first back support member and the seat member and the other located at an intersection of the second back support member and the seat member, wherein the first and second pivoting mechanisms are configured to establish at least a deployed configuration wherein a distal end of the back extends away from the seat member base plane and a collapsed configuration wherein the distal end of the back lies closer to the seat member base plane.

* * * * *